United States Patent [19]

Fischer et al.

[11] Patent Number: 4,459,096

[45] Date of Patent: Jul. 10, 1984

[54] IGNITER

[76] Inventors: David P. Fischer, Rte. #5, Box 2; Elbert B. Updike, Jr., 1705 General Longstreet Ave., both of Culpeper, Va. 22701

[21] Appl. No.: 438,401

[22] Filed: Nov. 1, 1982

[51] Int. Cl.[3] ..... F23Q 1/02

[52] U.S. Cl. ..... 431/274; 431/273; 431/276; 431/343

[58] Field of Search ..... 431/91, 127, 249, 250, 431/251, 253, 254, 269, 270–278, 28, 267, 139, 144, 129, 343; 126/25 B, 232

[56] References Cited

U.S. PATENT DOCUMENTS

| | | | |
|---|---|---|---|
| 242,132 | 5/1881 | Hutchison | 431/269 |
| 421,918 | 2/1890 | Farrell | 431/267 |
| 1,029,158 | 6/1912 | Voell | 431/275 |
| 1,666,610 | 4/1928 | Vartanian | 431/254 |
| 1,685,633 | 9/1928 | Heybach | 431/254 |

FOREIGN PATENT DOCUMENTS

| | | | |
|---|---|---|---|
| 223693 | 6/1910 | Fed. Rep. of Germany | 431/274 |
| 530996 | 7/1931 | Fed. Rep. of Germany | 431/254 |
| 463979 | 3/1914 | France | 431/277 |

*Primary Examiner*—Samuel Scott
*Assistant Examiner*—Carl D. Price
*Attorney, Agent, or Firm*—Russell J. Egan

[57] ABSTRACT

An igniter assembly is disclosed for detachable mounting on and use with a standard gas torch. The subject igniter can be actuated from a point remote from the torch nozzle to cause a shower of sparks above and across the torch nozzle to effect ignition of a gaseous mixture flowing from the torch.

14 Claims, 4 Drawing Figures

IGNITER

The present invention relates to an igniter for use with a gas torch, and in particular, to one which can be mounted on the torch head for convenient operation.

There are many known devices for igniting torches and the like. Some of them are capable of being mounted on the free end of the torch. For example, U.S. Pat. Nos. 3,052,112 and 3,275,060 show igniter assemblies which can be mounted on a torch and flipped into a position to provide a spark along a channel to the torch nozzle. Both of these devices can be actuated to create a spark from a point remote from the end of the nozzle. U.S. Pat. Nos. 1,416,845; 2,826,904; 2,986,208; and 3,154,936 all show somewhat similar devices except that the operator must actuate the igniter from a point much closer to the open flame.

U.S. Pat. No. 2,477,917 shows an igniter which is built right into the torch head. Thus, this igniter, which can be readily actuated by one hand by a point remote from the torch nozzle, requires a special design for the torch and therefore cannot be readily added to an existing torch.

The present invention overcomes many of the difficulties of the above discussed prior art by providing an igniter which can be readily attached to an existing gas torch. The subject igniter can also be operated from a point remote from the torch nozzle thereby providing both a convenience and safety factor. The subject igniter includes a housing having means to detachably mount on a torch head and containing therein a trigger connected to rotate a striker assembly from a position concealed within the housing to a position abutting the torch nozzle and strike the nozzle with sufficient force to activate the striker assembly to generate a shower of sparks across the nozzle of the torch. The striker assembly includes a striker arm and a striker housing. The striker arm carries a striker board and the striker housing carries an adjustable flint which moves across the strike board to produce sparks.

The present invention will now be described by way of non-limiting example with reference to the accompanying drawings in which.

Figure 1:
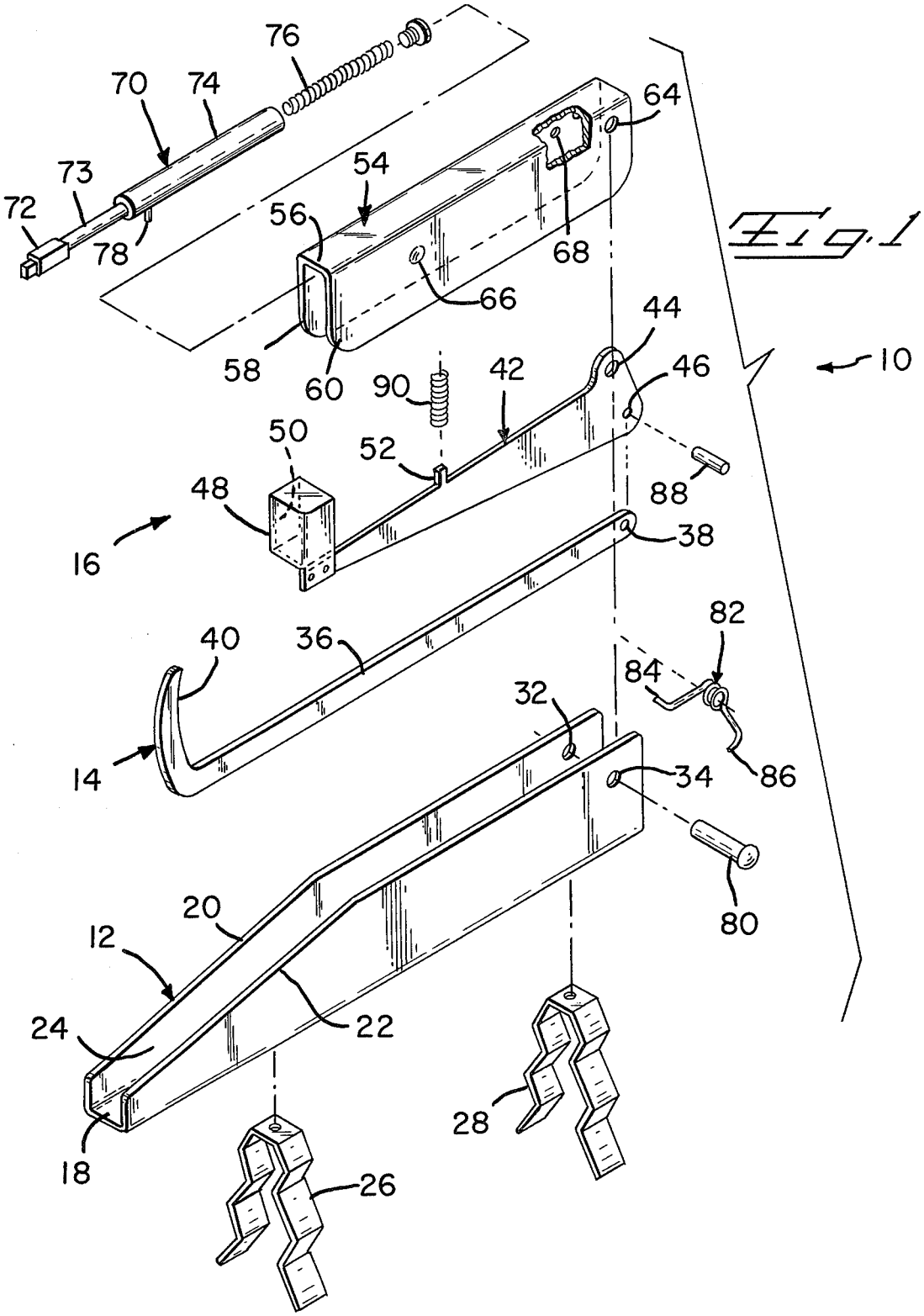
FIG. 1 is an exploded perspective view of the subject assembly.

The subject igniter 10 has three major components, namely, the housing 12, the trigger 14, and the striker assembly 16. The housing 12 is an elongated channel shaped metal member having a base 18 and a pair of sidewalls 20, 22 defining a channel 24 therebetween. A pair of torch mounting clip or clamp members 26, 28 are fixedly attached to the base 18 by bolts (not shown) or welding. There are also aligned mounting apertures 32, 34 at one free end of the sidewalls 20, 22.

The trigger 14 is an elongated metal member of any suitable cross section having a shaft 36 with a mounting hole 38 on one end and a trigger grip 40 at the opposite end extending normal to the axis of the shaft 36. Preferably the trigger 14 is somewhat shorter than housing 12 to lie totally within the housing in a non-actuated condition.

The striker assembly 16 includes a striker arm 42 having a pivot aperture 44 at one end and a trigger aperture 46 spaced therefrom. At the opposite end of the striker arm there is a striker box 48 extending normal to the axis of the striker arm 42 and to one side of the plane of the striker arm 42. On the interior of the striker box 48 there is a striker board 50 (see FIG. 3 and 4). The striker arm 42 also includes an integral spring lug 52. The striker housing 54 is a channel shaped member having a base 56, integral sidewalls 58, 60, a pivot aperture 64 at one end of each sidewall 58, 60 adjacent base 56, a detent 66 in each sidewall 58, 60, and a spring aperture 68 in sidewall 58. The striker housing 54 has the flint assembly 70 mounted therein. The flint assembly includes a flint 72 threaded on the end of shaft 73 which is spring biased to extend from a tube 74 by adjustable spring 76. The tube 74 has a lug 78 projecting therefrom.

The assembly of the present invention is completed by a pivot pin 80, a spring 82 having spring arms 84, 86, a second pin 88, and a helical spring 90.

Figure 2:
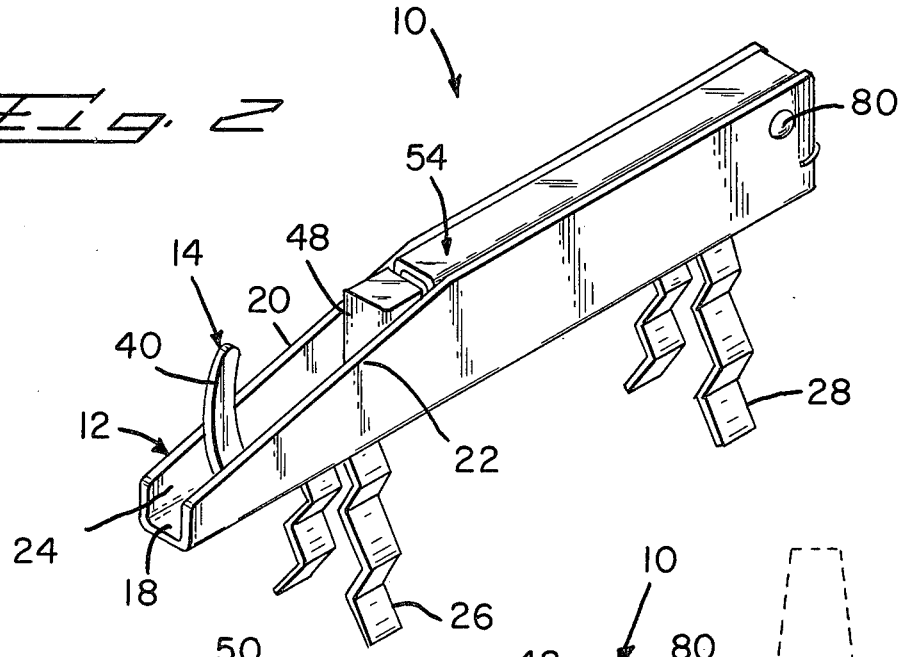
FIG. 2 is a perspective view of the subject invention in a fully assembled position.

The present invention is assembled with the flint 72 positioned on the end of shaft 75 biased by the spring 76 to extend from the tube 74. The flint assembly 70 is positioned in the housing 54 with the flint extending from one end thereof and the flint assembly 70 held in position by the detents 66. The trigger 14 is secured to the striker arm 42 by pin 88 extending through aligned apertures 38, 46. This assembly is placed partially in the housing 54 with the spring 90 being positioned between the lug 52 and the lug 78 and the arm 42 lying totally within the housing 12. The spring 82 is positioned with arm 84 extending through hole 68 in the striker housing 54 and the other arm 86 engaging sidewall 22 of housing 12. The pivot pin 80 is mounted through the aperture 32, 34 through the spring 82, the aperture 44 in the striker arm 42, and the aperture 64 in the striker housing 54. The igniter is now fully assembled as shown in FIGS. 2 and 3.

Figure 3:
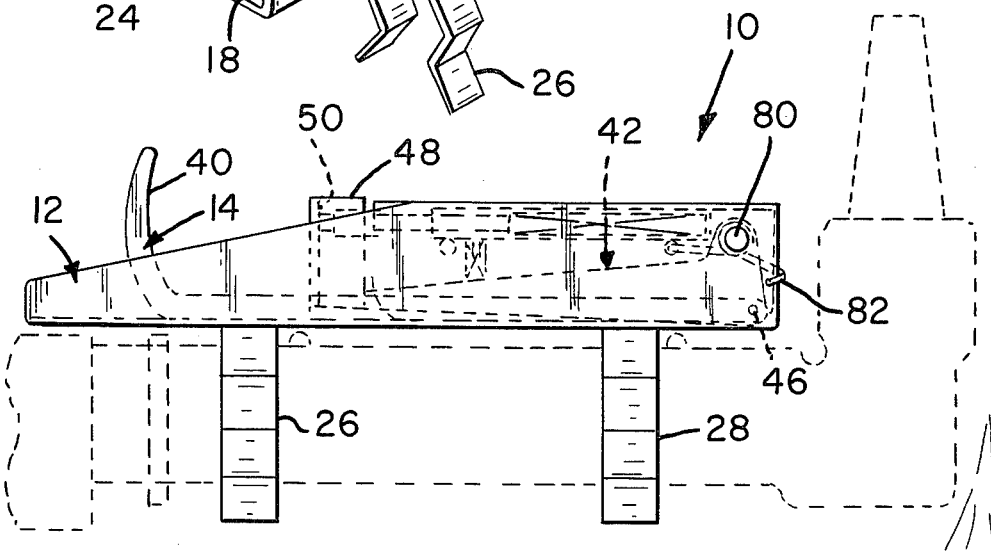
FIG. 3 is a side elevation showing the subject invention as it would be mounted on a known gas torch head.
Figure 4:
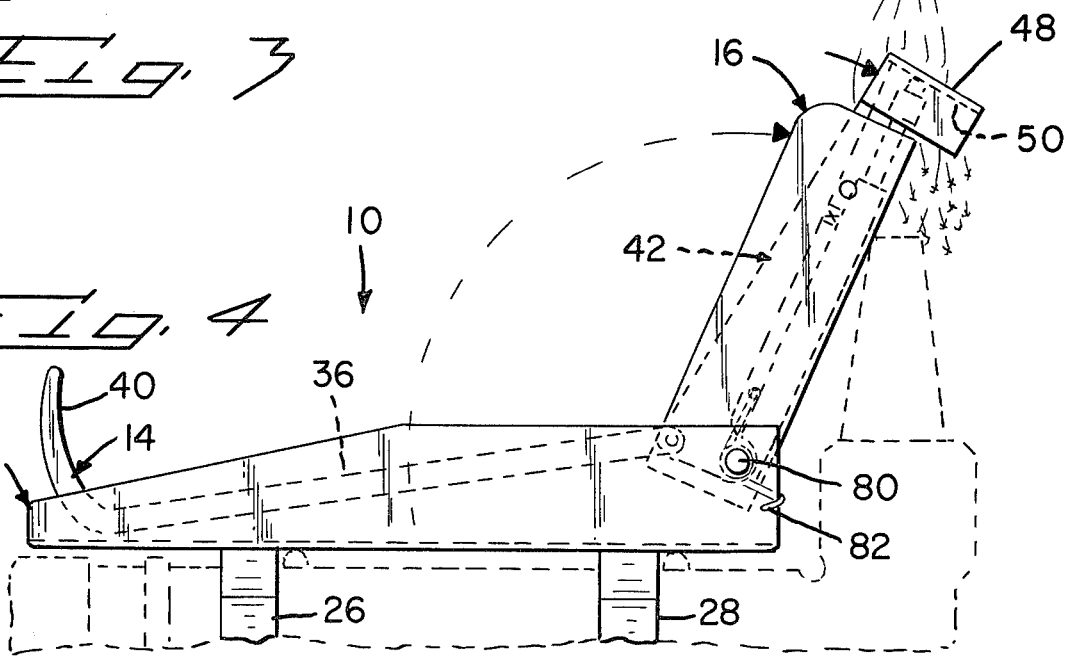
FIG. 4 is a side elevation, similar to FIG. 3, showing the subject invention in an actuated condition.

To actuate the subject invention, one pulls the trigger grip 40, to the left as shown in FIGS. 3 and 4, causing the striker assembly 16 to pivot around the pivot pin 80 against the force of spring 82. After traveling through an arc of greater than 90°, the striker housing 54 encounters the torch nozzle (see FIG. 4). The further relative movement of the striker arm 42 with respect to the striker housing 54 causes the fling 72 to move across the striker board 50 to generate a shower of sparks above and across the torch nozzle. Releasing the trigger 14 causes the return movement of the striker assembly 16 to the rest position shown in FIGS. 2 and 3 by the action of spring 82. It will be noted that during this return movement the flint 72 engaging strikes board 50 helps to keep the striker assembly 16 together.

We claim:

1. An igniter assembly for igniting a combustible mixture of gases flowing from a nozzle of a torch, said assembly comprising:

an elongated metal housing having means for detachably mounting said elongated metal housing on said torch adjacent the nozzle thereof;

a striker assembly mounted on a pivot at one end of the housing adjacent said nozzle, said striker assembly comprising a striker arm carrying a striker plate extending substantially normally from a free end thereof in cantilever fashion and a striker housing carrying flint means in opposition to and engaging said striker plate, said striker arm pivotally mounted for relative movement with said flint means of said striker housing, trigger means mounted along said elongated metal housing and connected to rotate said striker assembly around said pivot; and spring means biasing said striker assembly into said elongated metal housing, whereby actuation of said trigger means causes said striker assembly to rotate so that said striker housing hit against said torch nozzle and causes relative movement of said striker arm such that said striker plate moves across said flint means to generate a shower of sparks above and across said nozzle.

2. An igniter assembly according to claim 1 wherein said means for detachably mounting said housing on said torch comprises at least one clip.

3. An igniter assembly according to claim 1 wherein said means for detachably mounting said housing on said torch comprises at least one clamp.

4. An igniter assembly according to claim 1 wherein said elongated metal housing comprises:

a base and an integral pair of parallel spaced sidewalls extending therefrom defining a channel therebetween, said trigger means and said striker assembly being mounted in said channel and said pivot extending between said sidewalls at a point adjacent said torch nozzle and remote from said base.

5. An igniter assembly according to claim 1 wherein said striker housing is channel shaped and includes means to support said flint means therein.

6. An igniter assembly according to claim 1 further comprising:

second spring means normally biasing said striker arm and striker housing to a first position, engagement of said striker assembly against said nozzle overcoming said second spring means allowing relative movement of said striker arm and striker housing to a second position, said shower of sparks being generated during this movement.

7. An igniter assembly according to claim 1 wherein said flint means comprises:

a tube mounted in said striker housing, a shaft mounted in said tube to extend from one end thereof, spring means biasing a first end of said shaft within said tube, and a replaceable flint mounted on a second end of said shaft.

8. An igniter assembly according to claim 1 wherein said spring means is a helical spring mounted coaxially with said pivot and having one end attached to said striker housing and the other end engaging said elongated metal housing.

9. An igniter assembly for igniting a combustible mixture of gases flowing from a nozzle of a torch, said assembly comprising:

an elongated metal housing having a base and an integral pair of parallel spaced sidewalls extending therefrom defining a channel there between and means for detachably mounting said housing on said torch adjacent the nozzle thereof;

a striker assembly mounted on a pivot at one end of the channel adjacent said nozzle, said striker assembly having a pivotally mounted striker arm carrying a striker plate extending normally from the free end thereof in cantilever fashion and a striker housing pivotally mounted in opposition to said striker arm for relative movement with said striker housing, said striker housing carrying flint means in wiping engagement with said striker plate, trigger means mounted along said channel and connected to rotate said striker assembly around said pivot from a position of rest within said elongated metal housing to an ignition position abutting said torch nozzle; and spring means biasing said striker assembly into said channel, whereby actuation of said trigger causes said striker assembly to rotate until said striker housing hits against said torch nozzle causing relative movement of said striker arm such that said striker plate moves across said flint means to generate a shower of sparks above and across said nozzle.

10. An igniter assembly according to claim 9 further comprising:

second spring means normally biasing said striker arm and said striker housing to a first position, engagement of said striker assembly against said nozzle overcoming said second spring means to allow relative movement of said striker arm and striker housing to a second position, said shower of sparks being generated during this movement.

11. An igniter assembly according to claim 9 further comprising:

a box-like structure on the free end of said striker arm enclosing the periphery of said striker plate whereby the shower of sparks is directed toward said torch nozzle.

12. An igniter assembly according to claim 9 wherein:

said means for detachably mounting said elongated metal housing on said torch comprises at least one clip.

13. An igniter assembly according to claim 9 wherein said spring means is a helical spring coaxially mounted on said pivot with one end attached to said striker housing and the other end engaging said elongated metal housing.

14. In combination with a gas buring torch including a nozzle, an igniter assembly for igniting a combustable mixture of gases flowing from said nozzle of said torch, said assembly comprising:

an elongated metal housing having a base and an integral pair of parallel spaced sidewalls extending therefrom defining a channel there between and means for detachably mounting said housing on said torch adjacent the nozzle thereof;

a striker assembly pivotally mounted on a point at the end of the channel adjacent said nozzle, said striker assembly having a pivotally mounted striker arm carrying a striker plate extending normally from the free end thereof in cantilever fashion and a striker housing pivotally mounted for relative movement with and in opposition to said striker arm and further carrying flint means in wiping engagement with said striker plate, trigger means mounted along said channel and connected to rotate said striker assembly around said pivot from a position of rest within said elongated metal housing to an ignition position abutting said torch nozzle; and spring means biasing said striker assembly into said channel, whereby actuation of said trigger causes said striker assembly to rotate into engagement with said torch nozzle causing relative movement of said striker arm such that said striker plate moves across said flint means to generate a shower of sparks above and across said nozzle.

* * * * *